US011474453B2

(12) United States Patent
Takemoto et al.

(10) Patent No.: US 11,474,453 B2
(45) Date of Patent: Oct. 18, 2022

(54) DEVELOPING DEVICE USING SPIRAL STRUCTURES

(71) Applicant: HEWLETT-PACKARD DEVELOPMENT COMPANY, L.P., Spring, TX (US)

(72) Inventors: Kazuhiko Takemoto, Yokohama (JP); Takahiko Kimura, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/271,101

(22) PCT Filed: Sep. 9, 2019

(86) PCT No.: PCT/US2019/050180
§ 371 (c)(1),
(2) Date: Feb. 24, 2021

(87) PCT Pub. No.: WO2020/055734
PCT Pub. Date: Mar. 19, 2020

(65) Prior Publication Data

US 2021/0333726 A1 Oct. 28, 2021

(30) Foreign Application Priority Data

Sep. 10, 2018 (JP) ..... JP2018-168399

(51) Int. Cl.
*G03G 15/08* (2006.01)

(52) U.S. Cl.
CPC ..... *G03G 15/0889* (2013.01); *G03G 15/0891* (2013.01); *G03G 15/0893* (2013.01);
(Continued)

(58) Field of Classification Search
CPC ..... G03G 15/0889; G03G 15/0893; G03G 15/0891; G03G 2215/0819;
(Continued)

(56) References Cited

U.S. PATENT DOCUMENTS 9,316,948 B2 4/2016 Tsukijima et al.
9,348,262 B1 5/2016 Suenami
(Continued)

FOREIGN PATENT DOCUMENTS

EP 3076242 10/2016
JP 2003-307924 10/2003
(Continued)

*Primary Examiner* — Walter L Lindsay, Jr.
*Assistant Examiner* — Laura Roth
(74) *Attorney, Agent, or Firm* — Staas & Halsey LLP

(57) ABSTRACT

An imaging system comprises a stirring-conveyance member to supply developer to a developing roller. The stirring-conveyance member includes a spiral structure to convey the developer and a reverse spiral structure disposed downstream the spiral structure in a conveying direction of the developer. The reverse spiral structure has a maximum outer diameter at an upstream end in the conveying direction and a minimum outer diameter at a downstream end in the conveying direction. The minimum outer diameter is approximately ⅗ or less, of the maximum outer diameter.

16 Claims, 9 Drawing Sheets

(52) U.S. Cl.
CPC ..... *G03G 2215/083* (2013.01); *G03G 2215/0833* (2013.01)

(58) Field of Classification Search
CPC ..... G03G 2215/0827; G03G 2215/083; G03G 2215/0833; G03G 2215/0838
See application file for complete search history.

(56) References Cited

U.S. PATENT DOCUMENTS

| | | | | |
|---|---|---|---|---|
| 9,829,830 | B2 | 11/2017 | Sasaki | |
| 9,835,979 | B2 | 12/2017 | Suenami | |
| 2008/0056772 | A1 | 3/2008 | Utsumi et al. | |
| 2008/0170885 | A1 | 7/2008 | Hatakeyama et al. | |
| 2010/0202805 | A1 | 8/2010 | Miyoshi | |
| 2011/0229212 | A1* | 9/2011 | Hayashi ..... | G03G 15/0879 399/263 |
| 2016/0259269 | A1* | 9/2016 | Tanaka ..... | G03G 15/0893 |

FOREIGN PATENT DOCUMENTS

| | | |
|---|---|---|
| JP | 2005-345858 | 12/2005 |
| JP | 2011-28216 | 2/2011 |
| JP | 2017-54016 | 3/2017 |

* cited by examiner

DEVELOPING DEVICE USING SPIRAL STRUCTURES

CROSS REFERENCE TO RELATED APPLICATIONS

This application is a U.S. National Stage Application which claims the benefit under 35 U.S.C § 371 of International Patent Application No. PCT/US2019/050180 filed on Sep. 9, 2019, which claims priority from Japanese Patent Application No. 2018-168399 filed on Sep. 10, 2018, the contents of each of which are incorporated herein by reference.

BACKGROUND

Some developing devices in imaging apparatuses such as printers and multifunctional machines, use a two-component developer containing toner and carrier, and have a developing roller, a layer regulating member, a stirring-conveyance member, a developer container and the like. During operation of such developing devices, a developer held in a developer container is stirred and conveyed by a stirring-conveyance member; magnetically adsorbed by a rotating developing roller; and further shaped into a thin layer of developer by a layer regulating member. From the thin layer of developer, toner is adsorbed onto an electrostatic latent image on a rotating photosensitive body, so that the electrostatic latent image is developed.

From the viewpoint of cost reduction and resource reduction, some of such developing devices employ a developer replenishing technique or device to extend the service life, by replenishing and discharging the developer. Such a developing device may be provided with a developer replenishing section for replenishing developer in a developer container and a discharging section for discharging, to the outside of the developer container, developer that becomes a surplus after the replenishment.

During operation of such a developing device, air from outside the developing device is taken into the developing device by the developer on a rotating developing roller.

In addition, along with an increased speed of the printing performance of such a developing device, functional members inside the developing device rotate at a higher speed.

DETAILED DESCRIPTION

An example developing device using a two-component developer has a stirring-conveyance member for supplying a developer to a developing roller. The stirring-conveyance member has a spiral structure (or first spiral structure) for conveying the developer and a reverse spiral structure (or second spiral structure) disposed adjacent to and downstream of the first spiral structure in a conveying direction of the developer. The reverse spiral structure is a continuous reverse spiral structure starting with a predetermined maximum outer diameter at an upstream end in the conveying direction and ending with a predetermined minimum outer diameter at a downstream end in the conveying direction, and the minimum outer diameter is ⅗ or less of the maximum outer diameter.

The reverse spiral structure may have a maximum outer diameter portion having a diameter corresponding to the maximum outer diameter, and a varying portion disposed adjacent to and downstream of the maximum outer diameter portion in the conveying direction of the developer. The varying portion may have the maximum outer diameter at the upstream end in the conveying direction, the minimum outer diameter at the downstream end in the conveying direction, and a diameter gradually decreasing from the maximum outer diameter to the r minimum outer diameter. For example, the varying portion of the reverse spiral structure may have a first end having a diameter corresponding to the maximum outer diameter and a second end opposite the first end having a diameter corresponding to the minimum outer diameter, where the first end is upstream the second end relative to the conveying direction.

The above configuration helps eliminate or reduce, from a reverse spiral structure on a stirring-conveyance member, an element as a cause for winding up a developer. Thus, even when the stirring-conveyance member is rotated at a high speed, a deteriorated developer that has been overflown by replenishment of a developer and has climbed (or reached) over the reverse spiral structure can be discharged to the outside of a developer container without winding up the developer. In addition, other developer can be circulated within the developer container to maintain a suitable amount of the developer in the developer container.

Figure 1:
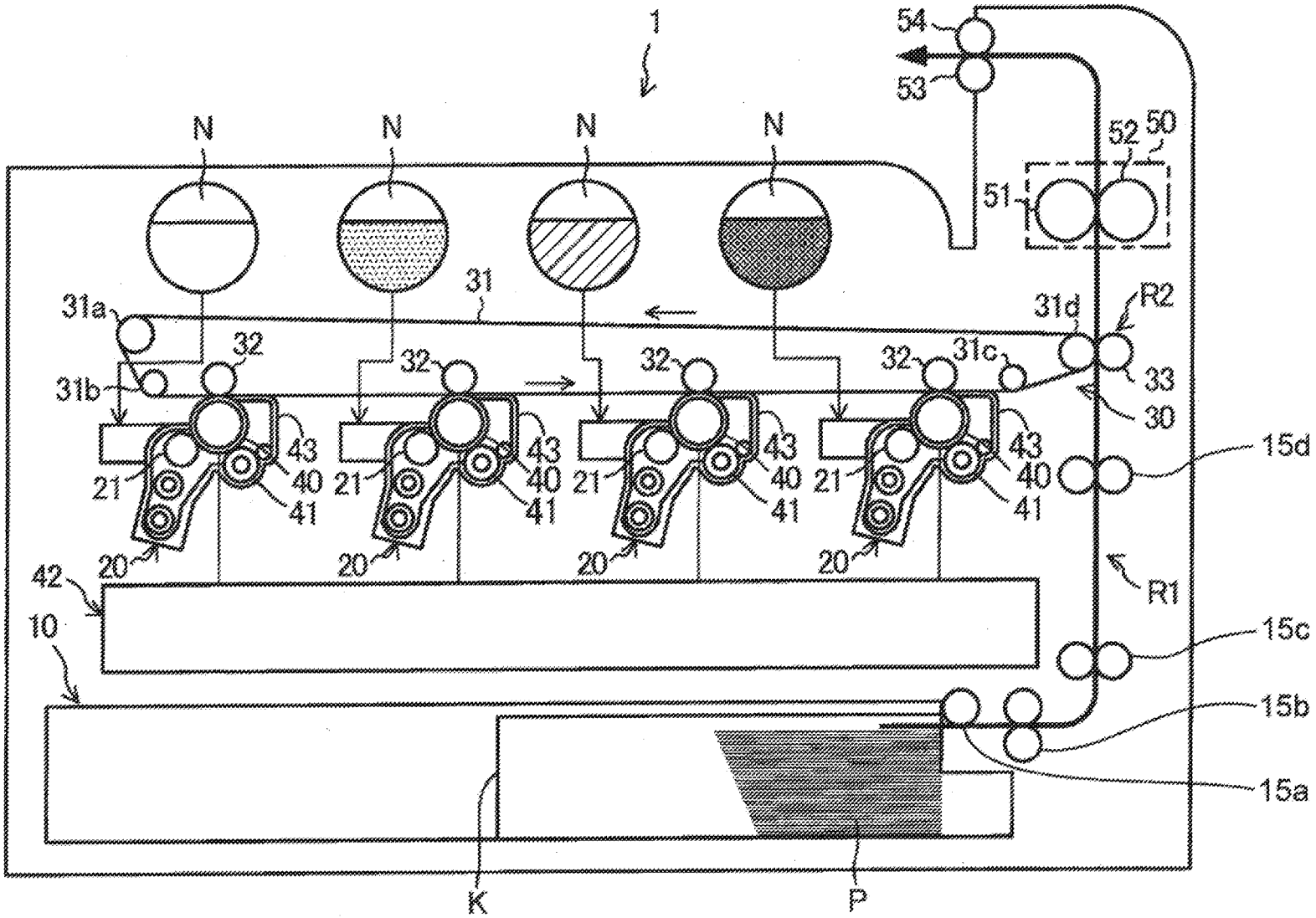
FIG. 1 is a schematic diagram of an example imaging apparatus.

In the following description, with reference to the drawings, the same reference numbers are assigned to the same components or to similar components having the same function, and overlapping description is omitted. An imaging system may include an imaging apparatus such as a printer, a device of the imaging apparatus such as a developing device or the like mounted on the imaging apparatus, or an imaging component.[0010] FIG. 1 illustrates an example imaging apparatus 1 capable of operating an example developing device. The imaging apparatus 1 is an apparatus for forming a color image by use of toner cartridges N of respective colors of magenta, yellow, cyan and black. The imaging apparatus 1 may form an image on a paper (recording medium) P.

The imaging apparatus 1 may have: a recording medium conveyance device 10 for conveying paper P; a developing device 20 for developing an electrostatic latent image; a transfer device 30 for a secondary transfer of a toner image to the paper P; a photosensitive body 40 as an electrostatic latent image carrier where an image is formed on an outer circumferential surface thereof; and a fixing device 50 for fixing the toner image on the paper P.

The recording medium conveyance device 10 may convey the paper P on which an image is to be formed, along a conveyance path R1. The paper P may be stacked and held in a cassette K, and picked up and conveyed by paper feeding rollers 15*a* to 15*d*. The recording medium conveyance device 10 may allow the paper P to arrive at a secondary transfer region R2 through the conveyance path R1 at the timing when the toner image to be transferred to the paper P arrives at the secondary transfer region R2.

One developing device 20 may be provided for each of four colors (e.g. the four colors magenta, yellow, cyan and black). Each developing device 20 has a developing roller 21 for allowing toner to be carried on the photosensitive body 40 (e.g. for toner to be transferred to the photosensitive body 40). The developing device 20 adjusts a mixing ratio between toner and carrier to a targeted ratio. The developing device 20 prepares a developer having toner dispersed uniformly, where the developer is imparted with an optimum charging amount. This developer is carried by the developing roller 21. When rotation of the developing roller 21 conveys the developer to a region facing the photosensitive body 40, toner from the developer carried on the developing roller is adsorbed onto an electrostatic latent image formed on an outer circumferential surface of the photosensitive body 40, so that the electrostatic latent image is developed.

The transfer device 30 may convey a toner image formed by the developing device 20 to the secondary transfer region R2 for secondary transfer to the paper P. The transfer device 30 may include a transfer belt 31, suspending rollers 31*a* to 31*d* suspending the transfer belt 31, a primary transfer roller 32 holding the transfer belt 31 together with the photosensitive body 40, and a secondary transfer roller 33 holding the transfer belt 31 together with the suspending roller 31*d*.

The transfer belt 31 may be an endless belt, which is circularly moved by the suspending rollers 31*a* to 31*d*. The primary transfer roller 32 may press the transfer belt 31 against the photosensitive body 40, from an inner circumference of the transfer belt 31. The secondary transfer roller 33 may press the transfer belt 31 against the suspending roller 31*d* from an outer circumference of the transfer belt 31.

One photosensitive body 40 may be provided for each of four colors (e.g. the four colors magenta, yellow, cyan and black), Each photosensitive body 40 is provided along a moving direction of the transfer belt 31, for example along a conveyance path of the transfer belt. The developing device 20, a charging roller 41, an exposure device 42 and a cleaning device 43 may be provided about, adjacent to in proximity to the photosensitive body 40.

The charging roller 41 may include charging means that uniformly charges the surface of the photosensitive body at a predetermined electric potential. The charging roller 41 may be driven following the rotation of the photosensitive body 40. The exposure device 42 exposes the surface of the photosensitive body 40 charged by the charging roller 41, to light, in accordance with the image to be formed on the paper P. This changes the electric potential of a portion of the surface of the photosensitive body 40, which has been exposed by the exposure device 42, and thereby, an electrostatic latent image is formed.

Each of the four developing devices 20 develops an electrostatic latent image formed on the corresponding photosensitive body 40 by transferring toner supplied from toner cartridges N, which are provided to face respective developing devices 20, so that a toner image is generated on the photosensitive body 40. The toner cartridges N are filled with magenta, yellow, cyan and black toners, respectively. The cleaning device 43 collects toner remaining on the photosensitive body 40 after the toner image formed on the photosensitive body 40 is primarily transferred to the transfer belt 31.

The fixing device 50 adheres and fixes the toner image, which has been secondarily transferred from the transfer belt 31, to the paper P. The fixing device 50 has a heating roller 51 for heating the paper P, and a pressing roller 52 for pressing the heating roller 51. The heating roller 51 and the pressing roller 52 both have a cylindrical shape. The heating roller 51 may include a heat source such as a halogen lamp located therein. A fixing nip portion as a contact region is provided between the heating roller 51 and the pressing roller 52, and passing the paper P through the fixing nip portion allows fusing and fixing of the toner mage on the paper P. After secondary transfer of the toner image on the paper P, toner remaining on the transfer belt 31 is collected by a belt cleaning device (not illustrated). The example imaging apparatus 1 may be provided with discharge rollers 53, 54 for discharging the paper P having the toner image fixed by the fixing device 50 to outside of the apparatus.

Example printing operations of the example imaging apparatus 1 will be described. When an image signal of an image to be recorded is input into the imaging apparatus 1, the imaging apparatus 1 rotates the paper feeding rollers 15*a* to 15*d*, and picks up and conveys the paper P stacked in the cassette K. The charging roller 41 uniformly charges the surface of the photosensitive body 40 at a predetermined electric potential. Based on the image signal received, the exposure device 42 applies laser light to the surface of the photosensitive body 40 to form an electrostatic latent image.

The developing device 20 develops the electrostatic latent image on the photosensitive body 40 to form a toner image. The formed toner image is primarily transferred from the photosensitive body 40 to the transfer belt 31 in a region where the photosensitive body 40 faces the transfer belt 31. Toner images formed on the four photosensitive bodies 40 are sequentially stacked or layered on the transfer belt 31, thereby forming a single composite toner image. Then, the composite toner image is secondarily transferred to the paper P conveyed from the recording medium conveyance device 10 in the secondary transfer region R2 where the suspending roller 31*d* and the secondary transfer roller 33 face each other.

The paper P having the composite toner image secondarily transferred thereto, is conveyed to the fixing device 50. The paper P is passed between the heating roller 51 and the pressing roller 52 while heat and pressure are applied to the paper; and thereby, the composite toner image is fused and fixed onto the paper P. Thereafter, the paper P is discharged by the discharge rollers 53, 54 to the outside of the imaging apparatus 1.

Figure 2:
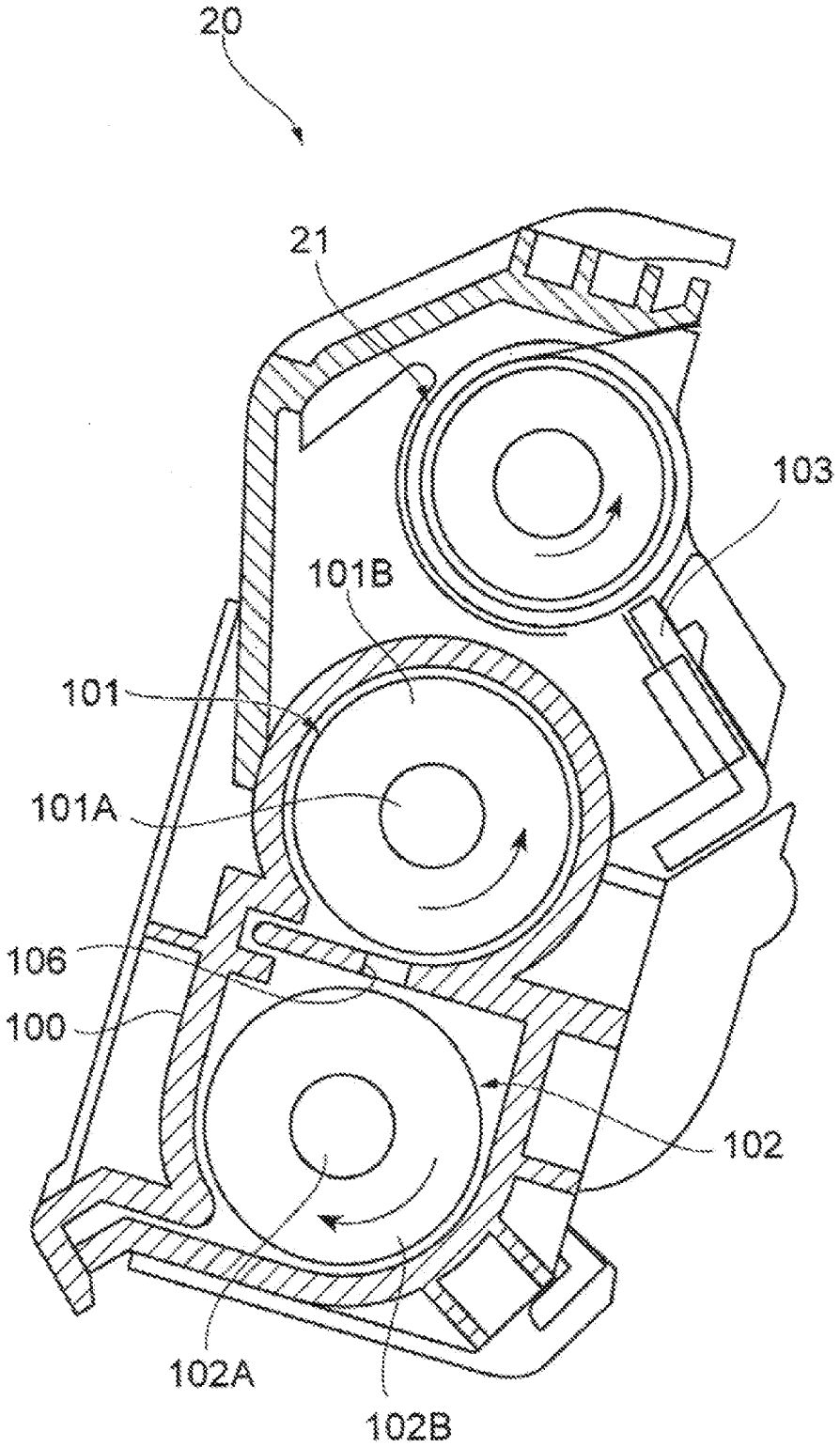
FIG. 2 is a schematic diagram of an example developing device.

FIG. 2 schematically illustrates the example developing device 20. The developing device 20 may have a developer container 100 for containing a developer (not illustrated) composed of toner and carrier, stirring-conveyance members 101, 102 for stirring the developer in the developer container 100, a developing roller 21 for magnetically adsorbing the developer stirred and conveyed by the stirring-conveyance members 101, 102, and a layer regulating member 103 for shaping or limiting the developer adsorbed on the developing roller 21 to a thin layer of developer. The stirring-conveyance member 101 has a rotation axis 101A and a spiral structure 101B projecting from the rotation axis 101A in a spiral shape; and the stirring-conveyance member 102 has a rotation axis 102A and a spiral structure 102B projecting from a rotation axis 102A in a spiral shape.

Figure 3:
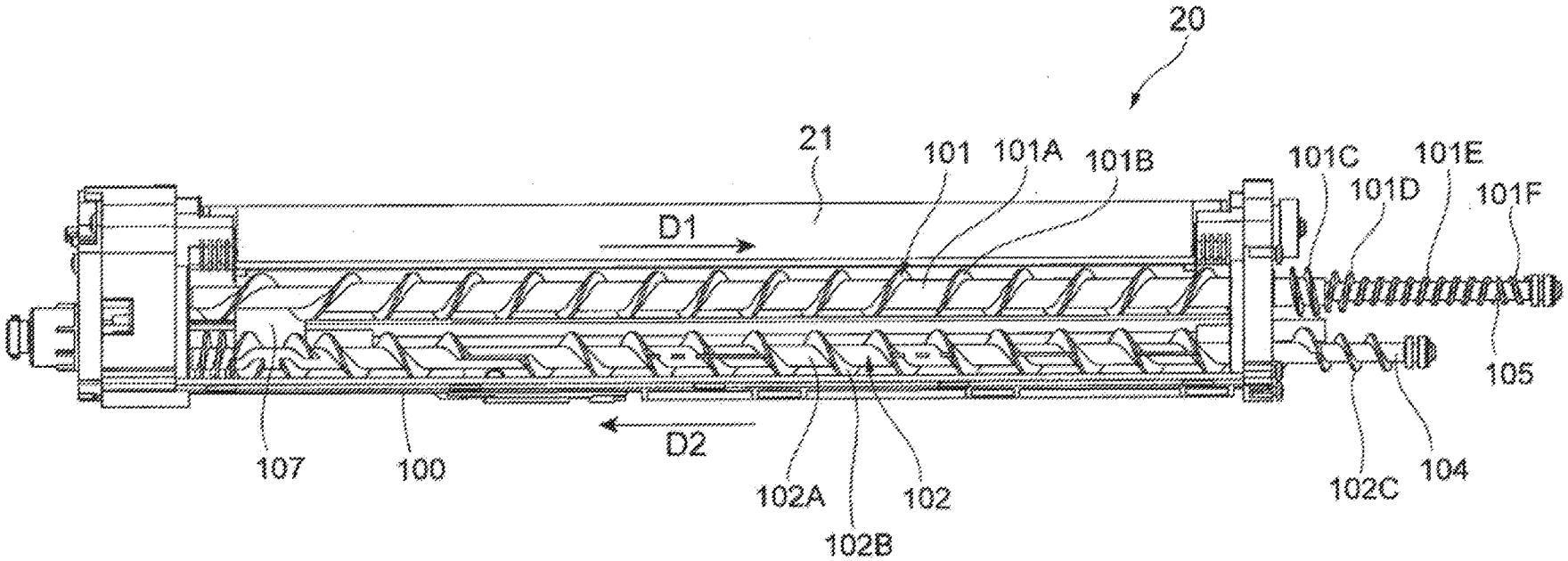
FIG. 3 is a schematic diagram of an example developing device including two stirring-conveyance members.
Figure 4:
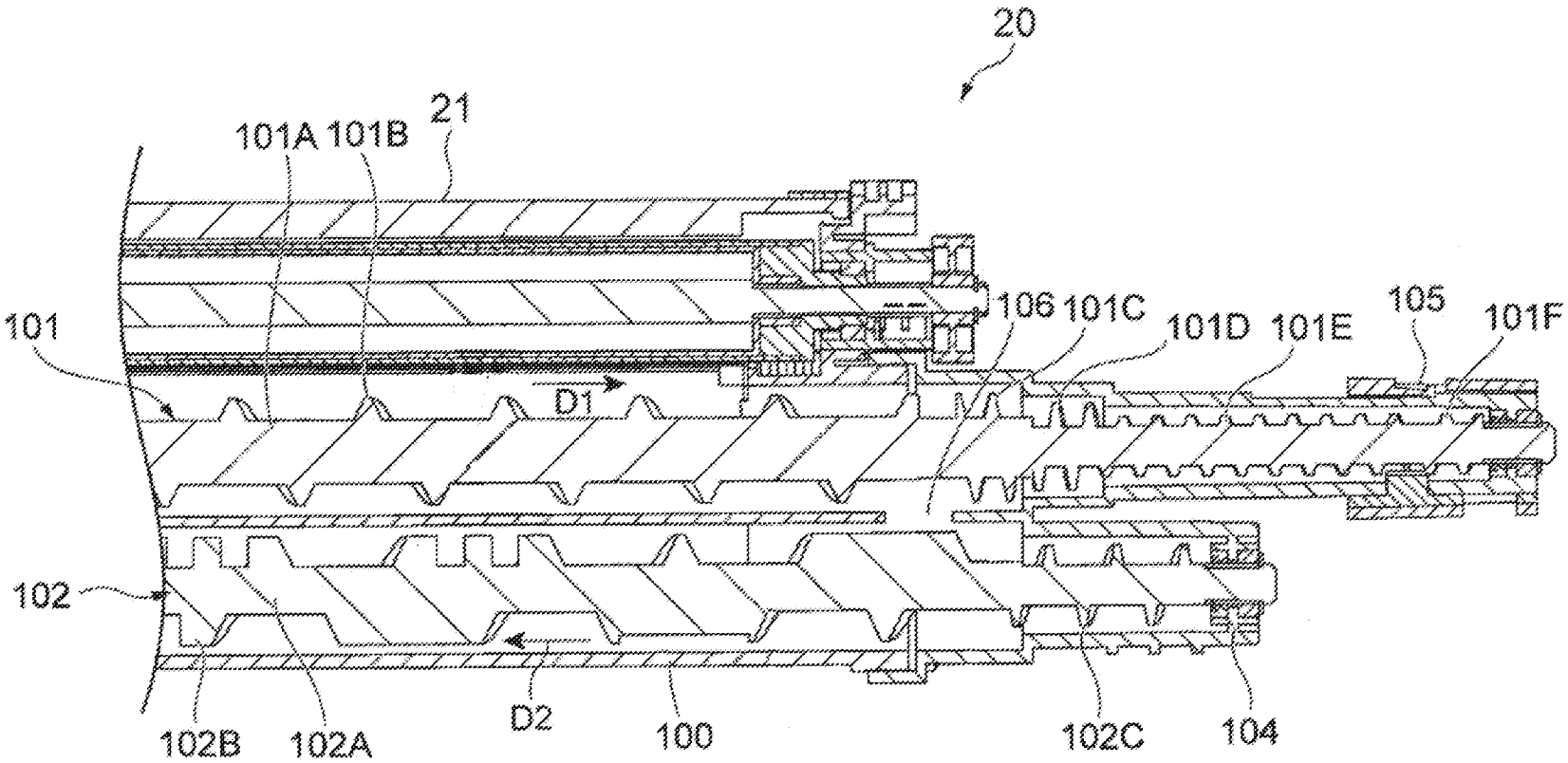
FIG. 4 is a schematic diagram of a portion of the example developing device, including a developer replenishing device.

FIG. 3 is illustrates an example developing device 20 from a side view and FIG. 4 illustrates an enlarged portion of the example developing device 20. With reference to FIG. 3 and FIG. 4, the example developing device 20 may replenish a toner tank N (see FIG. 1), at a time of toner replenishment, with a developer composed of carrier charged together with toner, from a developer replenishing section 104; and may discharge a deteriorated developer from a developer discharging section 105 to the outside of the developer container 100 by way of an overflow method. The developer replenishing section 104 may be provided at one end of the stirring-conveyance member 102 and the developer discharging section 105 may be provided at one end of the stirring-conveyance member 101.

The stirring-conveyance member 101 is for conveying a developer to the developing roller 21. The stirring-conveyance member 101 may convey, in a direction D1, the developer in the developer container 100 which has been replenished from the developer replenishing section 104. When the rotation axis 101A is rotated by a driving device (not illustrated), the stirring-conveyance member 101 moves the spiral structure 101B in the direction D1, so that the developer is conveyed in the direction D1 by the spiral structure 101B. For example, the stirring-conveyance member 101 may be driven to rotate about the rotation axis 101A, and the spiral structure 101B may be shaped to convey developer in the direction D1 when the stirring-conveyance member 101 rotates.

The stirring-conveyance member 102 is rotatable about the rotation axis 102A and has a spiral structure 102B projecting from the rotation axis 102A, in a spiral shape. The stirring-conveyance member 102 may convey, in a direction D2, the developer in the developer container 100 which has been replenished from the developer replenishing section 104. When the rotation axis 102A is rotated by a driving device (not illustrated), the stirring-conveyance member 102 moves the spiral structure 102B in the direction D2, so that the developer is conveyed in the direction D2 by the spiral structure 102B. For example, the stirring-conveyance member 102 may be driven to rotate about the rotation axis 102A, and the spiral structure 102B may be shaped to convey developer in the direction D2 when the stirring-conveyance member 102 rotates.

At a downstream end in the direction D1 of the spiral structure 101B of the stirring-conveyance member 101, a first opening 106 (see FIG. 4) may be disposed for delivering the developer from the stirring-conveyance member 101 to the stirring-conveyance member 102. At the downstream end in the direction D2 of the spiral structure 102B of the stirring-conveyance 102, a second opening 107 (see FIG. 3) may be disposed for delivering the developer from the stirring-conveyance member 102 to the stirring-conveyance member 101.

The stirring-conveyance member 101 may include a reverse spiral structure 101C for causing the developer moving in the direction D1 to flow backward (e.g. in the direction D2). The reverse spiral structure 101C may be disposed at the downstream end in the direction D1 of the spiral structure 101B of the stirring-conveyance member 101. The reverse spiral structure 101C moves developer in the direction D2 when the rotation axis 101A of the stirring-conveyance member 101 is rotated. The developer discharging section 105 is disposed further downstream from the reverse spiral structure 101C in the direction D1.

The stirring-conveyance member 101 may include spiral structures 101D, 101E, and a reverse spiral structure 101F further downstream from the reverse spiral structure 101C in the direction D1. The spiral structures 101D, 101E may be movable in the direction D1 at the time of rotation of the rotation axis 101A, and the reverse spiral structure 101F may be movable in the direction D2 at the time of rotation of the rotation axis 101A, For example, the spiral structures 101D, 101E may be shaped to convey developer in the direction D1 and the reverse spiral structure 101F may be shaped to convey developer in the direction D2, when the stirring-conveyance member 101 rotates about the rotation axis 101A. Thus, the developer that has climbed (or reached) over the reverse spiral structure 101C is conveyed to the developer discharging section 105 by the spiral structures 101D, 101E, and discharged to the outside of the developer container 100.

The stirring-conveyance member 102 may include a spiral structure 1020 movable in the direction D2 by rotation of the rotation axis 102A. The spiral structure 102C is disposed further in the direction D1 from the first opening 106 in the spiral structure 102B of the stirring-conveyance member 102. The spiral structure 102C conveys the developer replenished from the developer replenishing section 104 in the direction D2. For example, the spiral structure 102C may be shaped to convey the developer in the direction D2 when the stirring-conveyance member 102 rotates about the rotation axis 102A.

The example developing device 20 having such a developer replenishing device, may be subjected to a demand for increased speed, which may involve rotating functional members including the developing roller 21, and the stirring-conveyance members 101, 102 inside the developing device 20, at higher speed(s).

Figure 5:
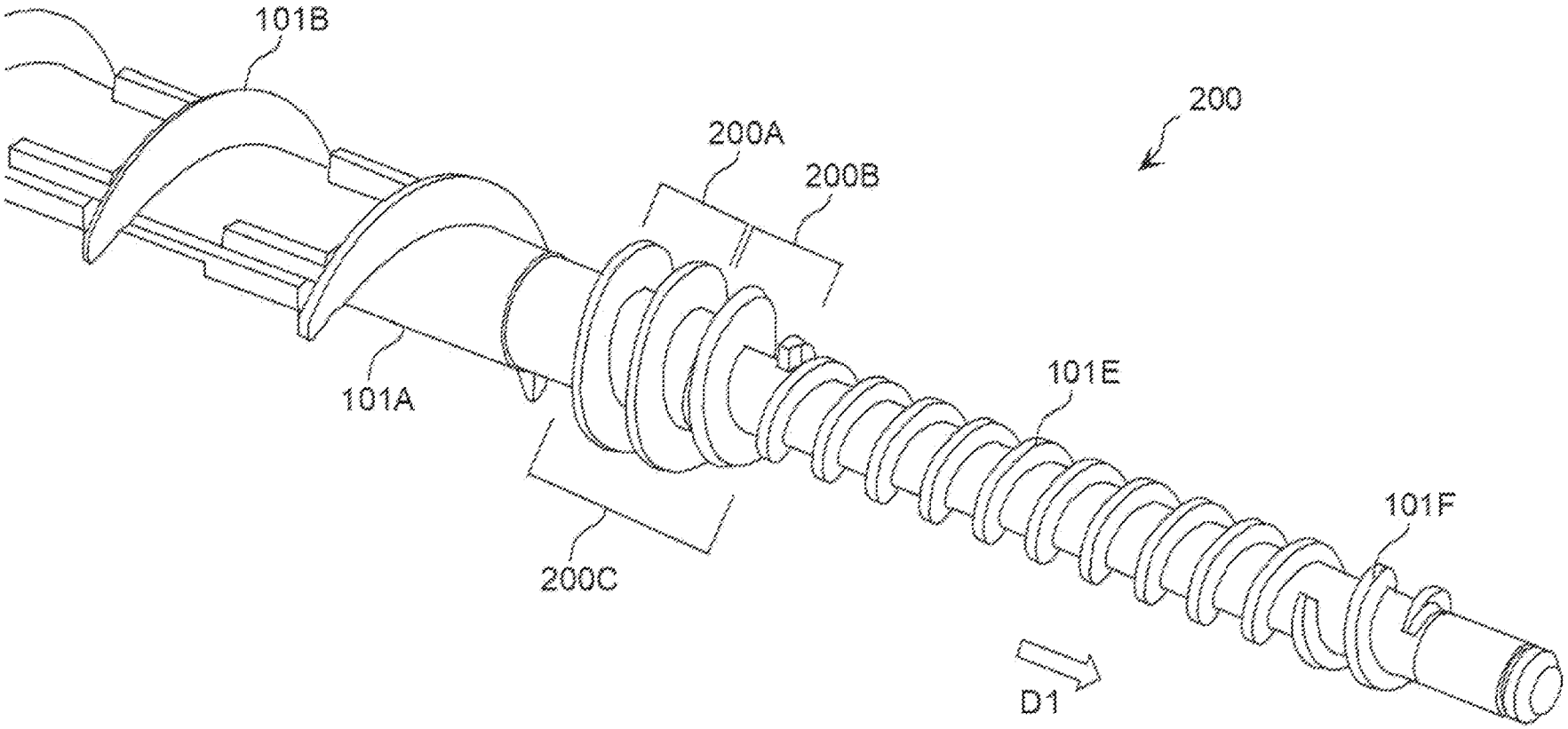
FIG. 5 is a perspective view of a portion of an example stirring-conveyance member.
Figure 6:
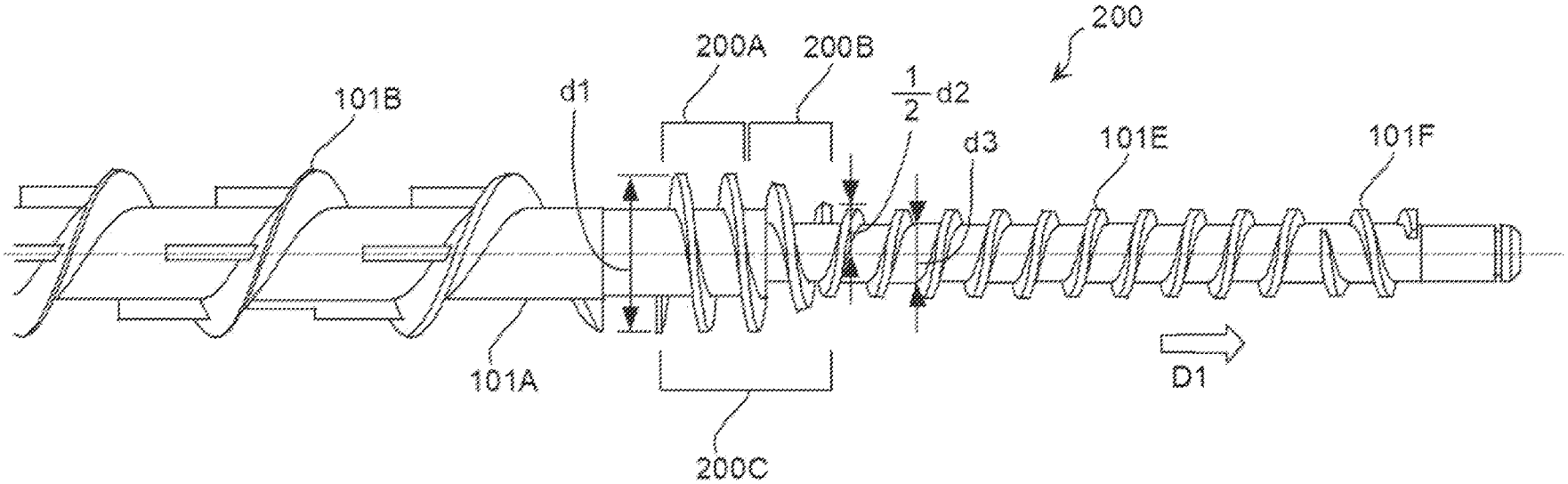
FIG. 6 is a side view of a portion of the example stirring-conveyance member.

FIG. 5 is a perspective view showing an example stirring-conveyance member 200, and FIG. 6 is a side view of the example stirring-conveyance member 200. The stirring-conveyance member 200 has a reverse spiral structure 200C disposed thereon, and the reverse spiral structure 200C may include a maximum outer diameter portion 200A having a maximum outer diameter d1 (see FIG. 6), and a varying portion 200B disposed adjacent to and downstream of the maximum outer diameter portion 200A, relative to a conveying direction D1 of developer. The varying portion 200B may have the maximum outer diameter d1 at an upstream end in the conveying direction D1 of the developer, has a minimum outer diameter d2 at a downstream end in the conveying direction D1 of the developer; and a diameter gradually decreasing from the maximum outer diameter d1 to the minimum outer diameter d2. For example, the maximum outer diameter portion 200A of the stirring-conveyance members 200 may be located adjacent a downstream end of the spiral structure 101B in the conveying direction D1, and may have a diameter corresponding to the maximum outer diameter d1. The varying portion 200B of the stirring-conveyance member 200 may have a first end and a second end, where the first end is located downstream the maximum outer diameter portion 200A and the second end is located downstream the first end, in the conveying direction D1. The diameter of the varying portion 2008 may correspond to maximum outer diameter d1 at the first end and may correspond to the minimum outer diameter d2 at the second end, and the diameter of the varying portion 200B may decrease gradually between the first end to the second end. The minimum outer diameter d2 may be ⅗ or less of the maximum outer diameter d1, and for example, it may be the same as an axial outer diameter d3 of the stirring-conveyance member 200. The reverse spiral structure may be a reverse spiral structure having the maximum outer diameter portion 200A with approximately 1.75 turns or spiral turns (e.g. approximately 630°) and the varying portion 200B with approximately 1.75 turns or spiral turns (e.g. approximately 630°). For example, the reverse spiral structure 200C along the axial direction of the stirring-conveyance member 200 may have a full length of approximately 20 mm or less.

In an example developing device using an example stirring-conveyance member 200 having such a configuration, when a developer is replenished from a developer replenishing section 104, the developer inside a developer container 100 may overflow; the overflown developer climbs (or reaches) over a reverse spiral structure 200C of the stirring-conveyance member 200; and then, it is conveyed by a spiral structure 101E to a developer discharging section 105, discharged to the outside of the developer container 100, and collected into a waste developer container (not illustrated).

The stirring-conveyance member 200 having the reverse spiral structure 200C may prevent an excessive discharge of a developer even when the stirring-conveyance member 200 rotates at a high speed for increasing the operation speed of the device.

For example, an overflown developer as a result of developer replenishment as described above may climb (or reach) over the maximum outer diameter portion 200A and the varying portion 200B of the reverse spiral structure 200C to move in the conveying direction D1 However, since the varying portion 200B is configured to have a diameter gradually decreasing from the maximum outer diameter d1 to the minimum outer diameter d2, this may prevent developer from being wound up even when the stirring-conveyance member 200 rotates at a high speed. As a result of developer replenishment, a developer that has climbed (or reached) over the reverse spiral structures 200A, 200B moves to the spiral structure 101E, and then, is discharged from the developer discharging section 105; while other developer may be forced (or urged) back by the reverse spiral structures 200A, 200B, delivered to the stirring-conveyance member 102 through the first opening 106 and circulated inside the developer container 100. As a result, the amount of developer inside the developer container 100 may be maintained at a suitable level.

Figure 7:
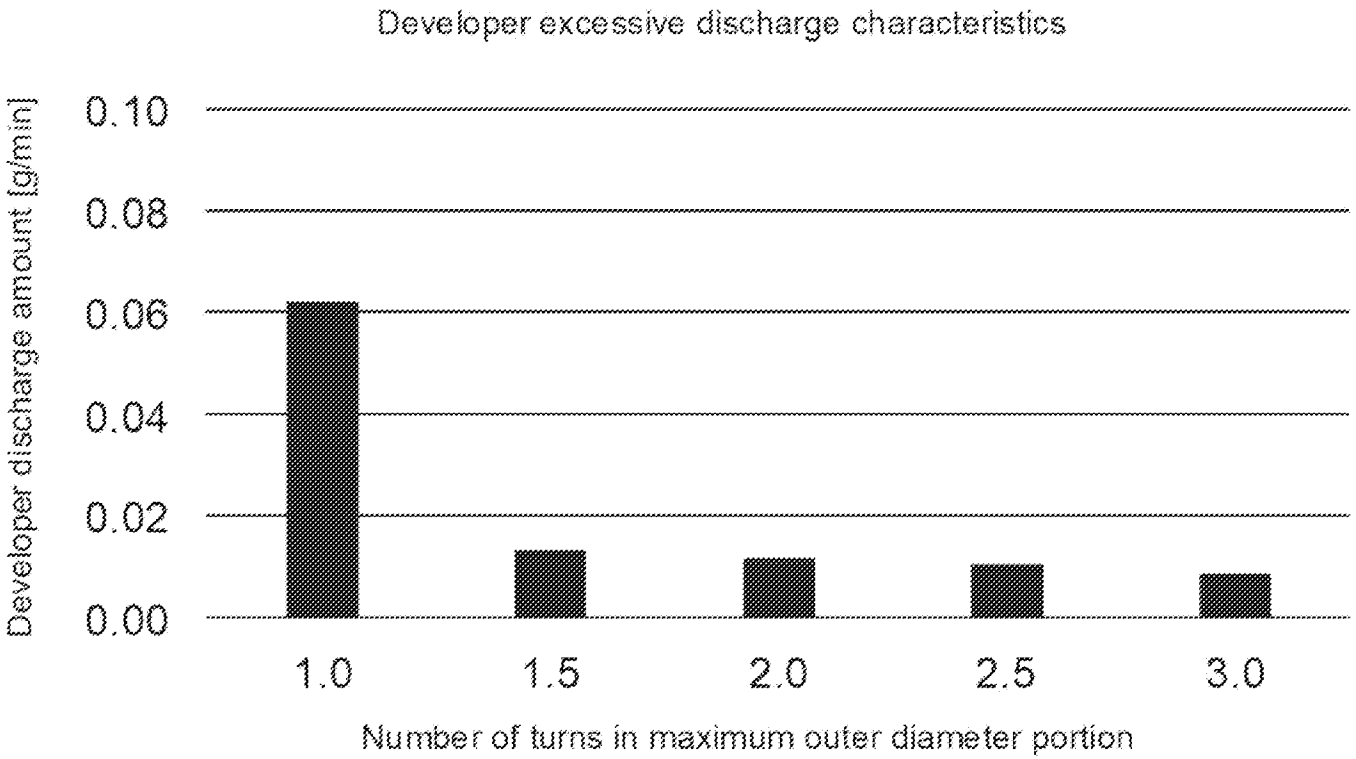
FIG. 7 is a graph showing a number of turns in a maximum outer diameter portion of a reverse spiral structure in relation to a developer discharge amount, for example stirring-conveyance members.

FIG. 7 is a graph showing developer excessive discharge characteristics for example stirring-conveyance members similar to the stirring-conveyance member 200 illustrated in FIGS. 5 and 6, wherein a varying portion 200B of a reverse spiral structure 200C has approximately 1.5 turns (or spiral turns), and the number of (spiral) turns in a maximum outer diameter portion 200A of the reverse spiral structure 200C is varied. In the graph, the vertical axis indicates a developer discharge amount per minute (g/min) and the horizontal axis indicates the number of (spiral) turns of the maximum outer diameter portion 200A of the example stirring-conveyance members. The graph shows results on the developer discharge amount measured when the stirring-conveyance member 200 is rotated at 120% of an existing developing device when the developer is not replenished by the developer replenishing device.

From the graph, it may be understood that when the maximum outer diameter portion 200A of the reverse spiral structure 200C has at least 1.5 turns (or spiral turns) approximately, the developer discharge amount is less than 0.02 g/min and an excessive discharge of developer is prevented. The graph shows that a maximum outer diameter portion 200A having at least 1.5 (spiral) turns approximately, causes a suitable amount of developer that is not overflown to flow backward, and to return to the developer container 100.

Figure 8:
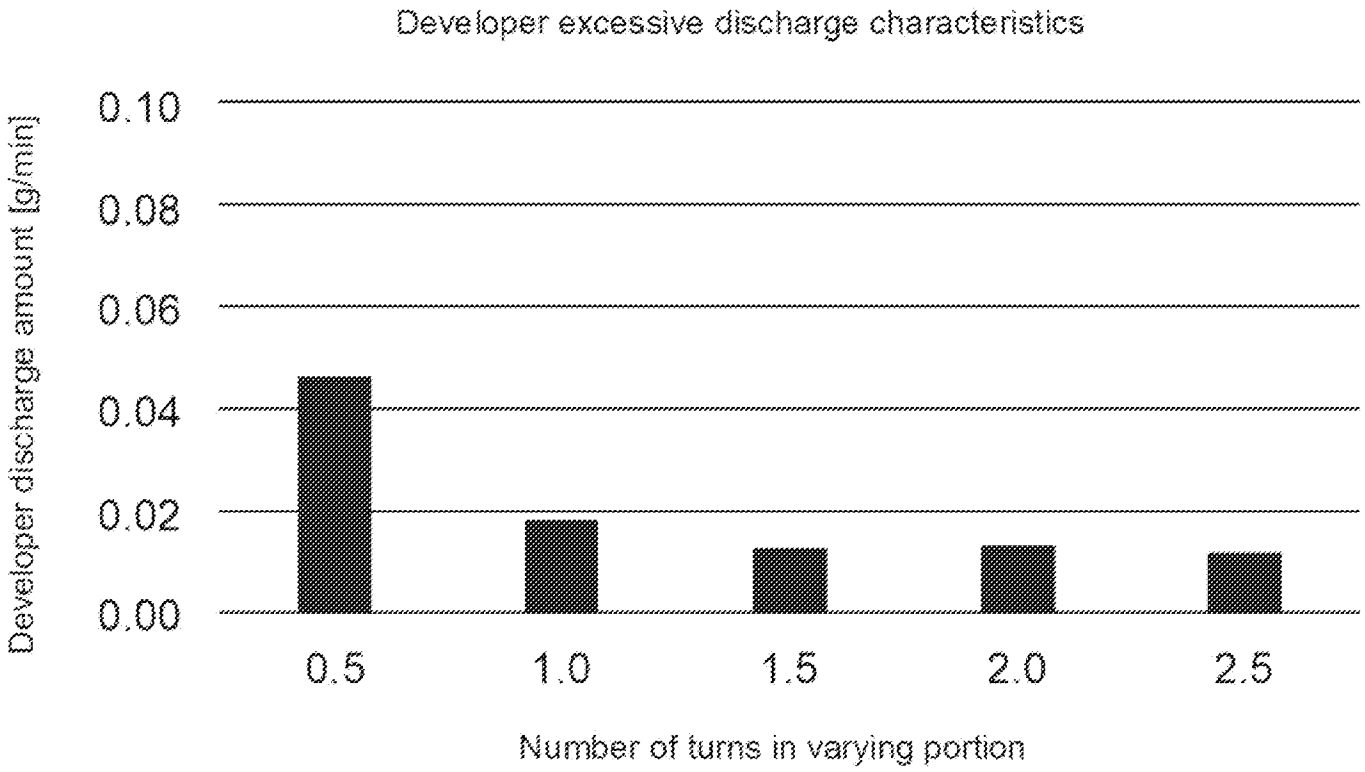
FIG. 8 is a graph showing a number of turns in a varying portion of a reverse spiral structure in relation to a developer discharge amount, for example stirring-conveyance members.

FIG. 8 is a graph showing developer excessive discharge characteristics for example stirring-conveyance members similar to the stirring-conveyance member 200 shown in FIGS. 5 and 6, wherein a maximum outer diameter portion 200A of a reverse spiral structure 200C has approximately 1.5 turns (or spiral turns), and the number of (spiral) turns in a varying portion 200B of the reverse spiral structure 200C is varied. In the graph, the vertical axis indicates a developer discharge amount per minute (g/min) while the horizontal axis indicates the number of (spiral) turns of the varying portion 200B. The graph shows results on the developer discharge amount measured when the stirring-conveyance member 200 is rotated at 120% of the rotation number of an existing developing device in the case that the developer is not replenished by the developer replenishing device.

From the graph, it may be understood that when the varying portion 200B of the reverse spiral structure 200C has at least approximately 1 turn or spiral turn (e.g. approximately 360°), the developer discharge amount is less than 0.02 g/min and an excessive discharge of developer is prevented. The graph shows that a varying portion 200B having at least 1 (spiral) turn approximately, causes a suitable amount of developer that is not overflown and that has climbed (or reached) over the maximum outer diameter portion 200A and dropped onto the varying portion 200B, to flow backward, and to return to the developer container 100.

Figure 9:
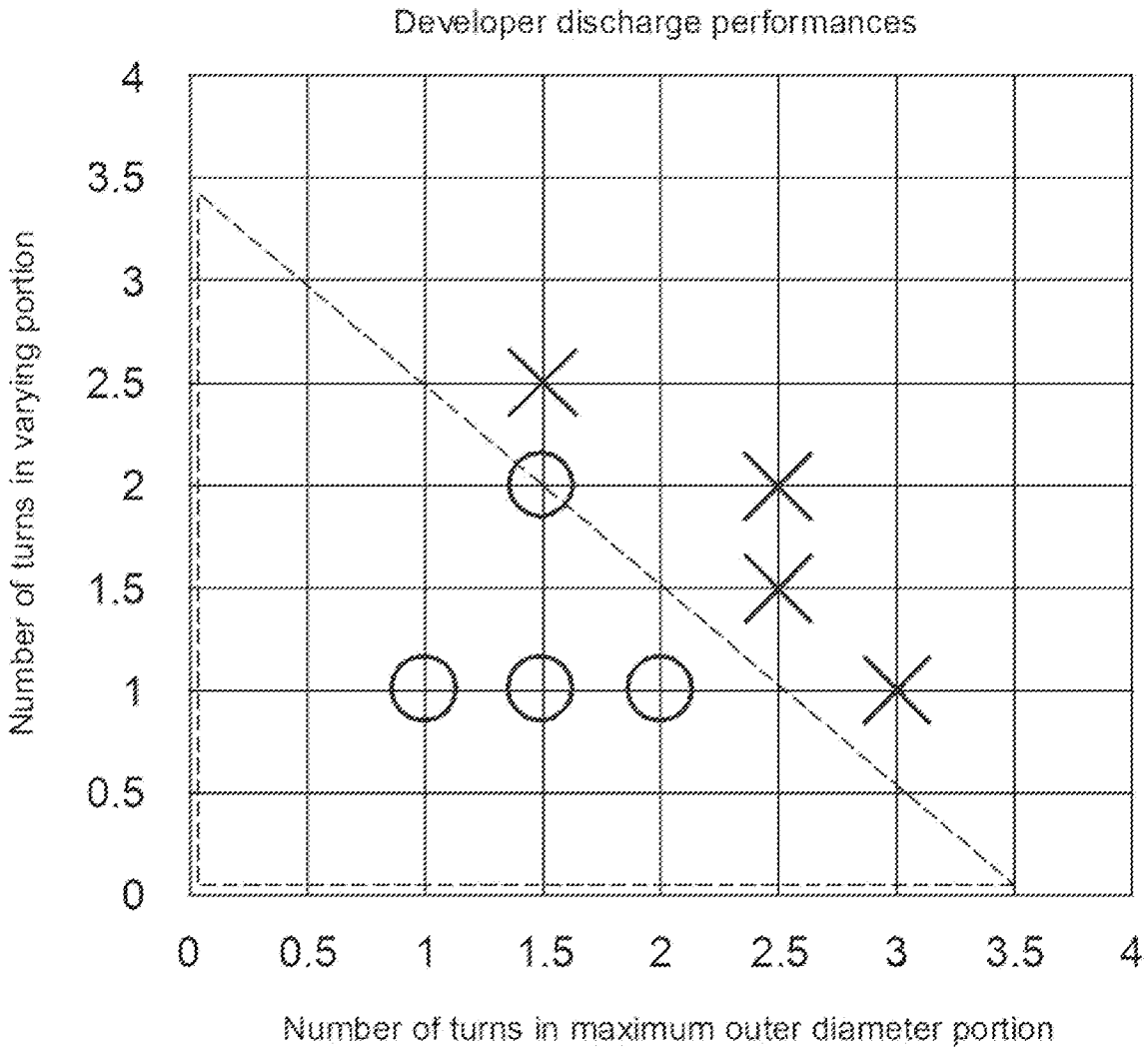
FIG. 9 is a graph showing developer discharge performances regarding combinations between numbers of turns of the maximum outer diameter portion and numbers of turns of the varying portion of the reverse spiral structure in example stirring-conveyance members.

FIG. 9 is a graph showing developer discharge performances of example stirring-conveyance members similar to the stirring-conveyance member 200 shown in FIGS. 5 and 6, wherein a maximum outer diameter portion 200A of a reverse spiral structure 200C and a varying portion 200B of the reverse spiral structure 200C are provided with varying numbers of (spiral) turns. In the graph, the horizontal axis indicates a number of (spiral) turns of the varying portion 200B and the horizontal axis indicates a number of (spiral) turns of the maximum outer diameter portion 200A. The graph shows whether or not a suitable amount of overflown developer is discharged and whether a suitable amount of developer is kept in the developer container 100 when the stirring-conveyance member 200 is rotated at 120% of the rotation number of an existing developing device and the developer is replenished by the developer replenishing device. In the graph, "O" indicates a combination of numbers of (spiral) turns that can maintain a suitable amount of developer while "X" indicates a combination of numbers of (spiral) turns that cannot maintain suitable amount of developer.

From the graph, it may be understood that when the number of (spiral) turns of the maximum outer diameter portion 200A of the reverse spiral structure 200C and the number of (spiral) turns of the varying portion 200B of the reverse spiral structure 200C have a total of approximately 3.5 turns (or spiral turns) or less (e.g. approximately 1260° or less), a good developer discharge performance is achieved. For example, an excessive discharge may be prevented while maintaining an ordinary developer discharge performance.

Example developing devices and/or imaging apparatus having a stirring-conveyance member with a reverse spiral structure as described herein provides a developing device and an imaging apparatus, which: cause substantially no excessive decrease of developer even under conditions for high-speed printing; necessitate substantially no special component or control for achieving that effect, without increasing cost of components or assembly; and provide suitable image quality over a long period with a more inexpensive configuration.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. An imaging system comprising:

a stirring-conveyance member to supply developer to a developing roller, wherein the stirring-conveyance member includes a spiral structure to convey the developer and a reverse spiral structure disposed adjacent to and downstream of the spiral structure in a conveying direction of the developer being conveyed by the spiral structure, wherein the reverse spiral structure is a continuous reverse spiral structure having a diameter corresponding to a maximum outer diameter at an upstream end in the conveying direction of the developer and corresponding to a minimum outer diameter at a downstream end in the conveying direction of the developer, wherein:

the reverse spiral structure has a maximum outer diameter portion having a diameter corresponding to the maximum outer diameter, and a varying portion disposed adjacent to and downstream of the maximum outer diameter portion in the conveying direction; and the varying portion has a diameter corresponding to the maximum outer diameter at an upstream end in the conveying direction, and corresponding to the minimum outer diameter at a downstream end in the conveying direction, wherein the diameter of the varying portion gradually decreases from the maximum outer diameter to the minimum outer diameter, wherein the maximum outer diameter portion having approximately 1.75 spiral turns and the varying portion having approximately 1.75 spiral turns.

2. The imaging system according to claim 1, wherein the minimum outer diameter is greater than an axial outer diameter of the stirring-conveyance member.

3. The imaging system according to claim 1, wherein the maximum outer diameter portion of the reverse spiral structure is composed of a reverse spiral structure having at least 1.5 turns approximately.

4. The imaging system according to claim 1, wherein the varying portion of the reverse spiral structure includes a reverse spiral structure having at least one turn.

5. The imaging system according to claim 1, wherein a total of the number of turns of the maximum outer diameter portion of the reverse spiral structure and the number of turns of the varying portion of the reverse spiral structure is approximately 3.5 turns or less.

6. The imaging system according to claim 1, wherein the reverse spiral structure along an axial direction of the stirring-conveyance member has a full length of approximately 20 mm or less.

7. The imaging system according to claim 1, comprising a developer replenishing device to replenish the developer and a developer discharging section to discharge an excessive developer caused by the replenishment from the developer replenishing device.

8. The imaging system of claim 1, wherein the minimum outer diameter is approximately ⅗ or less, of the maximum outer diameter.

9. A method of limiting discharge of developer in an imaging system, the method comprising:

conveying the developer in a stirring conveyance member, in a conveying direction toward a reverse spiral structure;

conveying the developer, by way of the reverse spiral structure, in a reverse direction opposite to the conveyance direction; and discharging excess developer having reached over the reverse spiral structure, wherein the reverse spiral structure is a continuous reverse spiral structure having a maximum outer diameter at an upstream end in the conveying direction and having a minimum outer diameter at a downstream end in the conveying direction, wherein:

the reverse spiral structure has a maximum outer diameter portion with the maximum outer diameter, and a varying portion disposed adjacent to and downstream of the maximum outer diameter portion in the conveying direction of the developer; and the varying portion has the maximum outer diameter at the upstream end in the conveying direction, the minimum outer diameter at the downstream end in the conveying direction, and the varying portion has a diameter gradually decreasing from the upstream end to the downstream end, wherein the maximum outer diameter portion having approximately 1.75 spiral turns and the varying portion having approximately 1.75 spiral turns.

10. The method of claim 9, wherein the minimum outer diameter is approximately ⅗ or less, of the maximum outer diameter.

11. An imaging system comprising:

a stirring-conveyance member to supply developer to a developing roller, wherein the stirring-conveyance member includes:

a conveyance spiral structure to convey the developer in a conveyance direction; and a reverse spiral structure located downstream of the conveyance spiral structure in the conveyance direction, to convey the developer in a reverse direction opposite the conveyance direction, wherein the reverse spiral structure has an upstream end having a maximum outer diameter and a downstream end located downstream the upstream end, in the conveyance direction, the downstream end having a minimum outer diameter, wherein:

the reverse spiral structure has a maximum outer diameter portion with the maximum outer diameter, and a varying portion disposed adjacent to and downstream of the maximum outer diameter portion in the conveying direction of the developer; and the varying portion has the maximum outer diameter at the upstream end in the conveying direction, the minimum outer diameter at the downstream end in the conveying direction, and the varying portion has a diameter gradually decreasing from the upstream end to the downstream end, wherein the maximum outer diameter portion having approximately 1.75 spiral turns and the varying portion having approximately 1.75 spiral turns.

12. The imaging system according to claim 11, wherein the minimum outer diameter is greater than an axial outer diameter of the stirring-conveyance member.

13. The imaging system according to claim 11, wherein the maximum outer diameter portion of the reverse spiral structure includes a reverse spiral structure having at least 1.5 turns approximately.

14. The imaging system according to claim 11, wherein the varying portion of the reverse spiral structure includes a reverse spiral structure having at least one turn.

15. The imaging system according to claim 11, wherein a total of the number of turns of the maximum outer diameter portion of the reverse spiral structure and the number of turns of the varying portion of the reverse spiral structure is approximately 3.5 turns or less.

16. The imaging system of claim 11, wherein the minimum outer diameter is approximately ⅗ or less, of the maximum outer diameter.

* * * * *